United States Patent [19]

Ogibayashi et al.

[11] Patent Number: 4,687,047

[45] Date of Patent: Aug. 18, 1987

[54] CONTINUOUS CASTING METHOD

[75] Inventors: Shigeaki Ogibayashi; Mamoru Yamada; Tatsuo Mukai; Makoto Tezuka; Masazumi Hirai, all of Kimitsu, Japan

[73] Assignee: Nippon Steel Corporation, Tokyo, Japan

[21] Appl. No.: 892,075

[22] Filed: Aug. 1, 1986

[30] Foreign Application Priority Data

| | | | |
|---|---|---|---|
| Aug. 3, 1985 | [JP] | Japan | 60-171314 |
| Aug. 3, 1985 | [JP] | Japan | 60-171315 |
| Dec. 30, 1985 | [JP] | Japan | 60-298773 |
| Dec. 30, 1985 | [JP] | Japan | 60-298774 |
| Jun. 13, 1986 | [JP] | Japan | 61-136276 |

[51] Int. Cl.[4] ..... B22D 11/00

[52] U.S. Cl. ..... 164/476; 148/2; 29/527.7

[58] Field of Search ..... 164/476, 76.1; 29/527.7; 148/2

[56] References Cited

U.S. PATENT DOCUMENTS 3,974,559 8/1976 Kawawa et al. ..... 29/527.7

FOREIGN PATENT DOCUMENTS 111557 9/1981 Japan .

*Primary Examiner*—Kuang Y. Lin

*Attorney, Agent, or Firm*—Wenderoth, Lind & Ponack

[57] ABSTRACT

A method of the continuous casting of molten metal by continuously withdrawing a strand is disclosed. The method is characterized in that the thickness of the strand is continuously reduced at a rate of 0.5 mm/min to less than 2.5 mm/min in the region between the point of time when the center of the strand has a temperature corresponding to a solid-phase ratio being within the range of 0.1 to 0.3 and the point of time when said temperature has dropped to a level corresponding to the solid-phase ratio at the limit of fluidization, while substantially no reduction in thickness is effected in the region between the point of time when the center of the strand has a temperature corresponding to the solid-phase ratio at the limit of fluidization and the point of time when said temperature has dropped to the solidus line.

6 Claims, 4 Drawing Figures

CONTINUOUS CASTING METHOD

BACKGROUND OF THE INVENTION

1. Technical Field

The present invention relates to a continuous casting method which is capable of producing a homogeneous continuous-cast section of a strand, that is directly obtained from molten metal by continuous casting and which has a liquid core, while preventing segregation of impurity element (e.g. sulfur, phosphorus and manganese in the case of a continuous-cast steel section) from occurring in the center of the thickness of the section.

2. Description of the Prior Art

As marine constructions, reservoirs, steel pipes for transporting oil and gas, and high-tensile wire rods are required to be built of steel materials that have better performance, it has become increasingly important to provide homogeneous steel materials. Theoretically, steel materials should have a uniform composition across their thickness, but steels generally contain impurity elements such as sulfur, phosphorus and manganese, which segregate during casting to provide a brittle steel where they are locally enriched. The use of the continuous casting process has increased today with a view to achieving higher production rate, yield and saving energy, but pronounced compositional segregation is often observed in the center of the thickness of the strand produced by the continuous casting process. It is highly desirable to reduce the occurrence of center segregation because not only does it significantly impair the homogeneity of the final product but it also causes a serious defect such as cracking by exerting stress on the steel during service of the product or while it is drawn into a wire rod. The mechanism behind the occurrence of center segregation is as follows: the steel that remains unsolidified at the final stage of solidification flows owing to such factors a the force of shrinkage due to solidification and is progressively enriched by washing out the enriched melt present in the vicinity of the solid-liquid interface. Therefore, in order to prevent center segregation, it is important to eliminate the causes of fluidization of the residual molten steel. The residual molten steel will become fluid not only by shrinkage due to solidification but also by the bulging of the strand between rolls and misalignment of the rolls. Of these factors, shrinkage upon solidification is most influential and, in order to prevent center segregation, the thickness of the strand (from which a slab, bloom or billet is obtained) must be reduced by the amount that compensate for this phenomenon.

Attempts have been commonly made to avoid segregation by reducing the thickness of a cast steel strand. See, for example, U.S. Pat. No. 3,974,559 wherein the strand being continuously cast is reduced in thickness at a rate not smaller than what is sufficient to compensate for the shrinkage upon solidification for the interval during which the temperature of the center of the strand drops from the liquidus line to the solidus line.

However, this method is not completely satisfactory for the purpose of preventing center segregation because little improvement is achieved under certain conditions, or segregation is increased, rather than decreased, in some cases.

SUMMARY OF THE INVENTION

The principal object, therefore, of the present invention is to provide a continuous casting method that is free from the aforementioned problems of the prior art and which is capable of producing a homogeneous metal material, for example, a homogeneous steel material which is a cast product such as a slab, bloom or billet.

The present inventors conducted thorough investigation of the cause of the problems that occur in the prior art and have found that the prior art can achieve little improvement or it sometimes increases, rather than decreases, the center segregation because the time schedule of solidfication for performing reduction in thickness and the range thereof are essentially inappropriate. In short, the prior art failed to consider the following three facts. First, mechanical factors such as misalignment and bending of rolls can increase the center segregation and this effect becomes pronounced as a greater amount of reduction in thickness is achieved. The net improvement achieved by reducing the thickness of the strand is expressed as the difference between the desirable effect attained by compensation of shrinkage due to solidification and the negative effect caused by mechanical factors. If the latter effect is greater than the effect achieved by compensation of shrinkage due to solidification, the amount of center segregation is increased, rather than decreased. The second fact to be considered is the amount of reduction in the thickness of the strand. This amount must be necessary and sufficient to compensate for the shrinkage due to solidification, and if the thickness of the strand is reduced by a greater amount, the center segregation is again increased. The third fact that has been overlooked in the prior art concerns a phenomenon generally referred to as linear segregation. This is such a segregation that the portion having the enriched composition occurs in a thin, continuous elongated form in the casting direction and in the center of the thickness of the strand when the strand is cut open in a direction parallel to the casting direction. This form of segregation is also observed as a network structure in a plane when the strand is cut open in parallel to the transversal direction of the strand. The linear segregation remains in the rolled product and renders it brittle since the highly enriched continuous portion provides a preferential route for the propagation of cracks. The linear segregation develops when the strand is subjected to excessive reduction in thickness at the final stage of solidification, and in order to maximize the effect of reduction under light conditions in eliminating segregation, some provision must be provided for allowing the segregation to occur in the form of separate spots, rather than in a continuous linear form.

In consideration of the above-mentioned fact, the present invention provides a continuous casting method that is characterized as follows.

(1) A method of the continuous casting of molten metal by continuously withdrawing a strand, characterized in that the thickness of the strand is continuously reduced at a rate being within the range of 0.5 mm/min to less than 2.5 mm/min in the region between the point of time when the center of the strand has a temperature corresponding to a solid-phase ratio being within the range of 0.1 to 0.3 and the point of time when said temperature has dropped to a level corresponding to the solid-phase ratio at the limit of fluidization, and substantially no reduction in thickness is effected in the region between the point of time when the center of the strand has a temperature corresponding to the solid-phase ratio at the limit of fluidization and the point of time when said temperature has dropped to the solidus line.

The term "molten metal" as used hereinabove means at least one molten material of metals and/or alloys such as steel. The term "solid-phase ratio" means the proportion of the solid phase in the center of the strand (and it means the term "fraction of solid"). The phrase "the thickness of the strand is continuously reduced" means that the thickness of the strand is continuously decreased by passage, at a specified rate, through, for example, at least two pairs of upper and lower rolls in a continuous casting machine. The phrase "substantially no reduction in thickness is effected" means that the gap between upper and lower rolls of each pair of rolls in stage II (to be defined hereinafter) is set to a constant value in the casting direction such that the thickness of the strand will not be intentionally decreased. In other words, the reduction rate is expressed as 0 mm/min and each pair of rolls simply serves to support the strand in such a manner that if bulging occurs in the strand, it is controlled. It should however be noted that in actual casting operations, unintentional reduction in the thickness of the strand will sometimes occur as a result of thermal deformation or other distortions under load. In this case, the reduction rate that is permissible in stage II in accordance with the present invention must be less than 0.5 mm/min and the reduction being within the range of this value may be regarded as being equivalent to the substantial absence of reduction in thickness.

(2) A continuous casting method as defined in (1) wherein said solid-phase ratio (i.e., fraction of solid) at the limit of fluidization is within the range of 0.6 to 0.9.

(3) A continuous casting method as defined in (1) or (2) wherein the amount of thermal warpage of rolls that occurs during casting in the region between the point of time when the center of the strand has a temperature corresponding to a solid-phase ratio of 0.1 to 0.3 and the point of time when said temperature has dropped to a level corresponding to the solid-phase ratio at the limit of fluidization is maintained to be less than 0.5 mm. The term "thermal warpage" is also called "thermal bending".

(4) A continuous casting method as defined in any one of (1) to (3) wherein the amount of wear of rolls is maintained to be less than 0.5 mm in the region between the point of time when the center of the strand has a temperature corresponding to a solid-phase ratio of 0.1 to 0.3 and the point of time when said temperature has dropped to a level corresponding to the solid-phase ratio at the limit of fluidization.

(5) A continuous casting method as defined in any one of (1) to (4) wherein the surface temperature of the strand is maintained to be not higher than 900° C. in the region between the point of time when the center of the strand has a temperature corresponding to a solid-phase ratio of 0.1 to 0.3 and the point of time when said temperature has dropped to a level corresponding to the solid-phase ratio at the limit of fluidization.

(6) A continuous casting method as defined in (1) wherein said molten metal is molten steel.

DETAILED DESCRIPTION OF THE PREFERRED EMBODIMENTS

Figure 1:
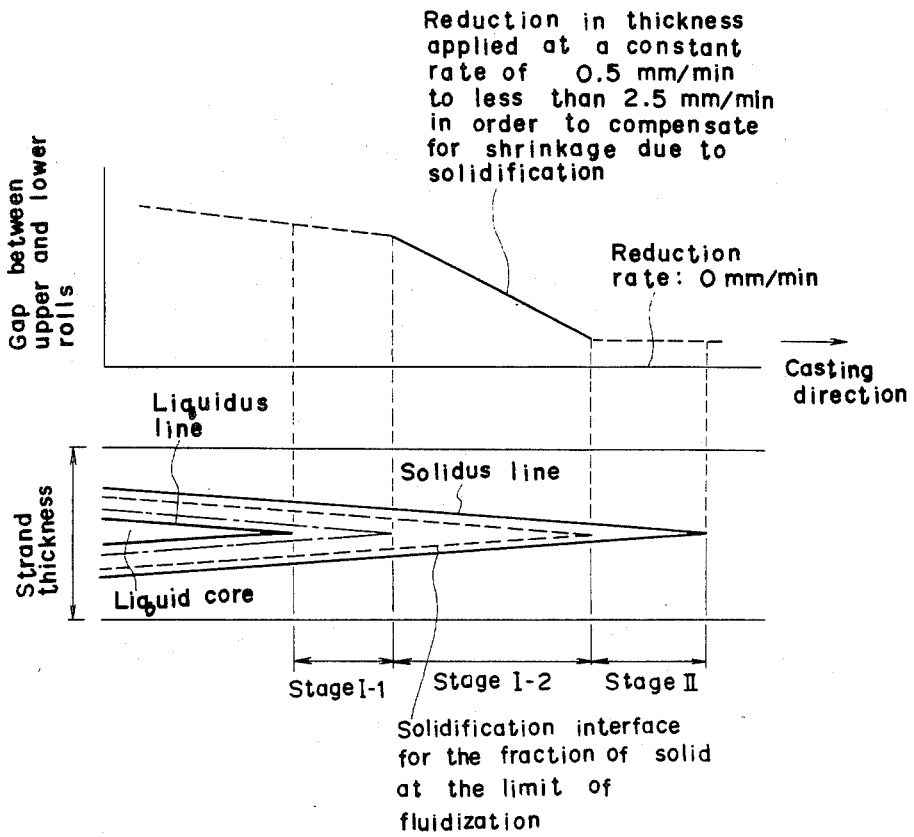
FIG. 1 is a diagram showing the relationship between each of the solidification stages provided in the method of the present invention, the amount of reduction in the thickness of the strand, and the range where such reduction should be effected.

Reduction in thickness under light conditions as described in U.S. Pat. No. 3,974,559 is an effective method for obtaining a steel strand having no center segregation. However, according to the findings of the present inventors, the region of the strand where its thickness should be reduced is the most important factor for this approach. Stated more specifically, the present inventors have found that in order to decrease the center segregation, it is important that within the region between the point of time when the center of the strand has a temperature corresponding to a solid-phase ratio of 0.1 to 0.3 and the point of time when said temperature has dropped to a level corresponding to the solid-phase ratio at the limit of fluidization (said region is hereinafter referred as stage I-2), the strand is continuously reduced in thickness such that the shrinkage resulting from solidification is compensated by the necessary and sufficient degree.

The term "solid-phase ratio at the limit of fluidization" means the upper limit of solid-phase ratio beyond which the molten steel will not be fluidized, and this value is within the range of 0.6 to 0.9.

The center segregation occurs as a result of fluidization of the molten steel within the region between the point of time when the center of the strand has the liquidus-line temperature and the point of time when the strand acquires the solidus-line temperature (i.e., the region where both solid and liquid phases exist in the strand). According to the findings of the present inventors, the effect of reducing the thickness of the strand in decreasing the amount of segregation is great in the downstream region where the center of the strand has a high solid-phase ratio and small in the upstream region. The reason is as follows: in order to compensate for the shrinkage due to solidification in the downstream region, the greater part of the molten steel supplied from the upstream side is composed of the portion in the vicinity of the center of thickness of the strand which has the smallest resistance to fluidization, but the concentration of impurity elements in the molten steel in the vicinity of the center of the thickness of the strand increases as the solid phase ratio of that central portion increases and, as a result, the amount of the enriched molten steel that is drawn into the finally solidified portion is greater in the downstream region than in the upstream region, causing more adverse effects on the purpose of eliminating the center segregation. On the other hand, in the upstream region where low concentrations of impurity elements are present in the central portion of the molten steel, the influence of the fluidization of molten steel on center segregation is small, so the effect of reduction in the thickness of the strand on center segregation is also small.

The present inventors found the following facts on the basis of many experimental results: (1) the gap between upper and lower rolls of each of the roll pairs in a continuous casting machine experiences some offset from the preset value during casting (this offset is hereunder referred to as dynamic misalignment); (2) the dynamic misalignment occurs as a result of the chattering of the bearing, the difference in the reaction force that develops in the direction of the width of the strand, the deflection of rolls or roll bending by heat; and r3) the greater the reaction force that is exerted on the rolls by the strand (i.e., the greater the amount of reduction in the thickness of strand), the greater the dynamic misalignment that develops, leading to additional or another cause of fluidization of the molten steel to increase the chance of center segregation. The net effect of reducing the thickness of the strand in decreasing the center segregation is expressed as the difference between the positive effect achieved by compensation of the shrinkage due to solidification and the negative effect caused by increased dynamic misalignment. The positive effect is increased in the downstream region and decreased in the upstream region, so if the strand is subjected to reduction in thickness in the upstream region, the negative effect caused by dynamic misalignment becomes greater than the positive effect achieved by compensation of the shrinkage due to solidification and the center segregation is increased, rather than decreased.

As a result of many experiments conducted in this respect, the present inventors found that the borderline lies at the point of time when the center of the thickness of the strand attains a temperature corresponding to a solid-phase ratio between 0.1 and 0.3 and that, with an ordinary industrial-scale continuous casting machine, the center segregation is increased, rather than decreased, by reducing the thickness of the strand present in the region upstream of that point of time. The increased amount in the center segregation becomes pronounced in proportion as the dynamic misallignment is increased due to poor servicing of the continuous casting machine and as a greater reduction in the thickness of the strand is achieved. Stated more specifically, in the region that is upstream of the point of time when the center of the strand has a temperature corresponding to a solid-phase ratio between 0.1 and 0.3 and which is downstream of the point of time when the center of the strand acquires a temperature corresponding to the liquidus line (this region is hereunder referred to as stage I-1), the effect of reduction in thickness under light conditions in favor of the purpose of decreasing the center segregation is so mall that the center segregation may be increased, rather than decreased, unless the dynamic misalignment is controlled to be at a very small level. Therefore, in principle it is desirable that the strand is not subjected to reduction in thickness when it is within stage I-1. If this is done, the reduction rate should be less than 0.5 mm/min and a greater reduction in thickness should not be effected. The rolls in the reduction area are usually required to be provided with a support structure that is capable of withstanding the reaction force exerted by the reducing operation and this adds to the initial cost of the continuous casting machine. Therefore, in this sense, the absence of reduction in the thickness of the strand which lies within stage I-1 has the additional advantage of economy resulting from the decreased initial investment.

In the region that is downstream of the point of time when the center of the strand has a temperature corresponding to the solid-phase ratio at the limit of fluidization and which is upstream of the point of time when the center of the strand acquires a solid phase (this region is hereunder referred to as stage II), the unsolidified molten steel in the center of the thickness of the strand is divided by the solid phase and each portion of the molten steel is isolated from another. Therefore, the molten steel will not be fluidized at all even if it is subjected to the force of shrinkage due to solidification and there is no need to reduce the thickness of the strand. On the other hand, if the strand in stage II is subjected to excessive reduction in thickness, the center segregation will assume a linear form which is deleterious to the quality of the final product. From the viewpoint of product quality, the center segregation must be controlled in the form of tiny separate spots which is most advantageous or least deleterious to the final product. In order to attain this form of segregation, substantially no reduction in thickness should be achieved within stage II and, if dynamic misalignment should cause unavoidable reduction in thickness, the reduction rate must be controlled to be less than 0.5 mm/min.

In consideration of the above facts, the region where reduction in the thickness of the strand is intentionally achieved in the method of the present invention is stage I-2 which is between the point of time when the center of the strand has a temperature corresponding to a solid-phase ratio of 0.1 to 0.3 and the point of time when said temperature has dropped to a level corresponding to the solid-phase ratio at the limit of fluidization. If the dynamic misalignment is so small that the negative effect of reduction in thickness is substantially negligible, the strand in stage I-1 may also be subjected to reduction in thickness by the same degree as provided in stage I-2 for the purpose of compensating for the shrinkage due to solidification. On the other hand, if the dynamic misalignment is not controlled to be at a small level, the reduction rate for stage I-1 must be less than 0.5 mm/min in order to minimize the negative effect on the purpose of reducing the center segregation. In addition, irrespective of the amount of dynamic misalignment, substantially no reduction in thickness should in principle be achieved in stage II which is downstream of stage I-2. The relationship between the roll gap and the state of solidification in each of the stages I-1, I-2 and II in accordance with the present invention is shown in FIG. 1.

The amount of reduction in thickness that should be provided for strand is hereunder discussed.

Figure 2:
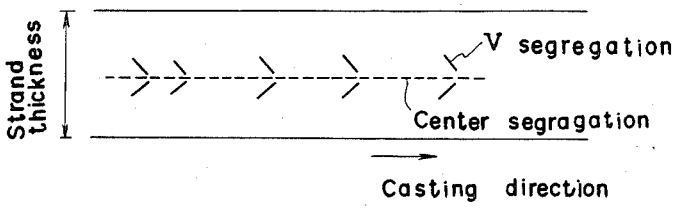
FIG. 2 shows diagrammatically the center and V-shaped segregations that occur in a continuous cast strand.

The continuously cast strand usually contains not only the center segregation but also a V-shaped segregation (V segregation) as illustrated in FIG. 2. The V segregation occurs as a result of shrinkage upon solidification and the number of V segregations that have developed can be used as an index for the sufficiency of reduction in thickness with respect to the amount of shrinkage due to solidification. As a result of close observation of the V segregation, the present inventors have found the following two facts. The first fact relates to how the amount of reduction in thickness should be considered. According to the finding of the present inventors, what is important for the purpose of compensating for the shrinkage due to solidification is not the amount of reduction (in mm) achieved by one roll, but the average reduction rate (mm/min) for the range of several meters in the vicinity of the crater end (the end of solidification). The term "reduction rate" may be defined as the amount by which an arbitrary point on the strand is reduced in thickness per unit time as it passes through a pluriality of roll pairs. Assuming the roll gap setting in actual casting operations, the reduction gradient (mm/m), or the reduction rate divided by the casting speed, may be used as the amount of reduction per unit length in the casting direction (i.e., the amount of drawing or tapering between rolls). The other fact relates to the amount of reduction that is necessary and sufficient for compensation of the shrinkage due to solidification (this amount is hereunder referred to as the appropriate or optimum amount of reduction). If the actual amount of reduction is smaller than the appropriate amount, V segregation pointing to the casting direction will occur. On the other hand, if the actual amount of reduction is larger than the appropriate amount, a reverse V segregation will occur which is pointed away from the casting direction and is directed to the meniscus in the mold. The appropriate amount of reduction may be defined as the amount of reduction which causes neither V nor reverse V segregation. This appropriate amount of reduction varies with the thickness of the strand, its width and the conditions of cooling the strnad; if a slab is produced, the appropriate amount is typically within the range of 0.5–1.5 mm/min, and if a bloom or billet is produced, the range of not lower than 1.0 mm/min and less than 2.5 mm/min is appropriate.

The present inventors also investigated the effect of reducing conditions on the center porosity. As a result, it was found that the center porosity could be appreciably decreased by performing the appropriate reduction in thickness in stage I-2. Further decrease in the center porosity can be achieved by providing reduction in thickness in stage II but this effect is very small compared with the case where no reduction in thickness is achieved in stage II. Therefore, it suffices that the appropriate reduction in thickness is effected in only stage II for the purpose of increasing the homogeneity of the strand.

The effect of reducing the thickness of the strand in decreasing the center segregation may be further enhanced by employing the following means. As already mentioned, the net effect of reducing the thickness of the strand in decreasing the center segregation is defined as the difference between the positive effect achieved by compensating for the shrinkage due to solidification and the negative effect caused by increasing the dynamic misalignment. Therefore, in order to maximize the effect of reduction in thickness, the adverse effect of dynamic misalignment must be minimized. Misalignment of rolls can be caused by wrong setting of the roll gap or the chattering of the bearing, but the misalignment caused by such factors has already been held at satisfactory low levels in the prior art system. The present inventors have found that in addition to these "static" misalignments which can be quantified prior to starting the casting operation, misalignment can also be caused by the passage of a hot strand between rolls. Thue roll misalignment in the broad sense of the term which includes this additional misalignment will be called dynamic misalignment. While several factors exist that cause the dynamic misalignment, the thermal warpage of rolls is most important. The phenomenon in which rolls warp as a result of distortion by the heat of the strand (this phenomenon is sometimes called roll bending) has been known for many years and several methods have been proposed for solving this problem. See, for example, Japanese Laid-Open Patent Publication No. 111557/1981 which discloses a method wherein continuous casting is performed with the thermal warpage of rolls being corrected by means of spraying cooling water. However, none of the prior art techniques have attempted to control the thermal warpage of rolls in relation to the reduction of the thickness of the strand because the causal relationship between the thermal warpage of rolls and the center segregation of the strand has not been fully quantified and because neither the area of the continuous-casting machine which would cause adverse effects nor the relationship with the reduction in thickness of the strand has been known. The present inventors made thorough investigation of these factors and have obtained the following observations: the thermal warpage of rolls causes noticeable effects on the center segregation if the strand is within the region between the point of time when the center of the strand has a temperature corresponding to a solid-phase ratio of 0.1 to 0.3 and the point of time when said temperature has dropped to the solidus line (i.e., the region including stages I-2 and II); the adverse effect of the thermal warpage of rolls becomes pronounced as the strand is subjected to a greater reduction in thickness; and, in order to maximize the effect of reducing the thickness of the strand in decreasing the center segregation, it is effective to hold the amount of thermal warpage of rolls at less than 0.5 mm while the strand is within the region where its thickness is being reduced. The thermal warpage of rolls can be held at low levels by several methods, such as by cooling the rolls intermittently or by dividing each roll into two or more separate members such that at least three bearing portions are provided in the direction of the width of the strand.

Figure 3:
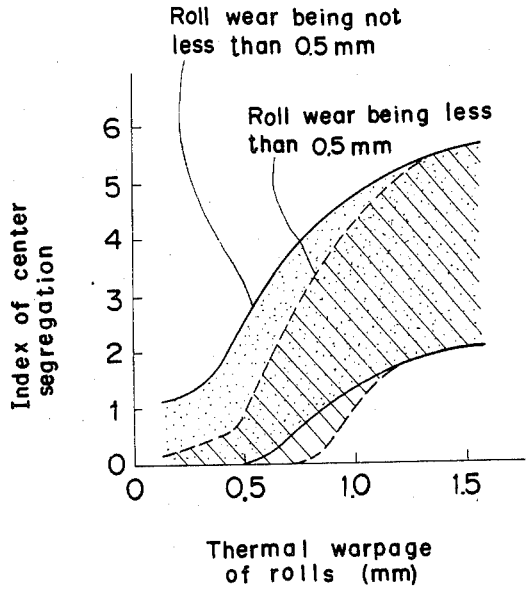
FIG. 3 is a diagram showing the relationship between the center segregation, the thermal warpage of rolls and the wear of rolls.

Another important cause of dynamic misalignment is the wear of rolls. As the number of casting operations that handle strands of different widths is increased, the surface of each roll will wear unevenly in the longitudinal direction of the roll. The worn roll has a very rough surface which sometimes contains grooves as deep as 1 mm or more. This roll wear has not been strictly controlled in the prior art for several reasons: the difference in wear between adjacent rolls arranged in the casting direction is comparatively small; an attempt to reduce the roll wear is not economical since it simply results in a shorter roll life (the period during which the roll can be used until it must be repolished or replaced by a new one); and the causal relationship between the roll wear and the center segregation has not been well defined. The present inventors made close studies on the state of roll wear and investigated its relationship with the center segregation. As a result, the inventors have obtained the following observations: (1) a worn roll causes the molten steel to be fluidized as a result of nonuniform reduction in the thickness of the strand which is conducted in the casting and transversal directions, thereby increasing the chance of center segregation; (2) the adverse effect of roll wear is most pronounced in stage I-2; and (3) this adverse effect is increased as a greater reduction in the thickness of the strand is achieved. As shown in FIG. 3, in order to enhance the effect of reduction in thickness in decreasing the center segregation, it is effective to hold the thermal warpage of rolls to be less than 0.5 mm. A further improvement can be achieved by reducing the amount of roll wear to less than 0.5 mm. In accordance with the present invention, all the rolls disposed within the region where the thickness of the strand is deduced should be controlled such that each of the thermal warpage and wear of rolls is less than 0.5 mm. The amount of roll wear is defined in terms of the depth of grooves in one roll as measured in its longitudinal direction.

Figure 4:
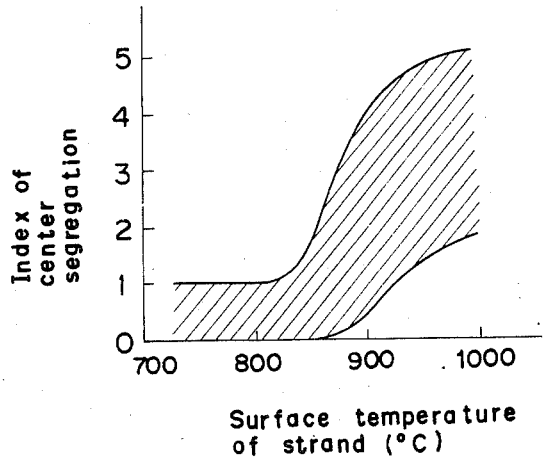
FIG. 4 is a diagram showing the relationship between the center segregation and the surface temperature of the strand.

The present inventors also found that the adverse effect of any dynamic misalignment could be effectively minimized by maintaining the surface temperature of the strand at a low level while it was within the region where its thickness was being reduced. As shown in FIG. 4, the surface temperature of the strand must be held at 900° C. or below, preferably at 850° C. or below, in order to minimize the adverse effect of dynamic misalignment. By maintaining the surface temperature of the strand at this low level, the rigidity of the solidified shell is increased to a sufficiently high level to render the strand highly resistant to local deformation and, as a result, the adverse effect of uneven reduction in thickness that results from dynamic misalignment is suppressed and the intended effect of reducing the thickness of the strand in decreasing the center segregation is achieved in a more efficient manner. The increase in the rigidity of the solidified shell as a result of the decrease in the surface temperature of the strand also means an increase in the reaction force provided during reduction in the thickness of the strand. Therefore, in practicing the method of the present invention, it is necessary that the rolls be provided with a sufficient compressive force to ensure a predetermined amount of reduction in thickness. In this case, excessive reduction in thickness may be avoided by inserting a spacer between the bearing portions of upper and lower rolls. The surface temperature of the strand may be readily maintained at 900° C. or below by performing casting operations with proper adjustment being made with respect to the conditions of secondary cooling such as the quantity of water to be sprayed. If, in this case, the thermal warpage of rolls is maintained to be less than 0.5 mm, the improvement in center segregation due to the increase in the rigidity of the solidified shell is more effectively achieved.

When alloy steels such as a niobium-containing steel are produced with a bow type or vertical bending type continuous casting machine, cracks will sometimes occur in the surface of the strand because of the straightening strain and/or bending strain that develops in the straightening zone and/or bending zone. Such surface cracking is not likely to occur if the surface temperature of the strand exceeds 900° C. but has a tendency to occur frequently if the surface temperature is 900° C. or below. If the method of the present invention is to be applied to such alloy steels, the casting speed and the reduction zone must be set to realize a desirable practice such as, for example, the one wherein the surface temperature of the strand is held above 900° C. until it enters the straightening zone, with the strand being subsequently quenched so that stage I-2 will lie ih the horizontal zone where the surface temperature of the strand can be maintained at 900° C. or below.

The present invention will be further explained by way of the following examples.

EXAMPLE 1

With a view to obtaining the composition shown in Table 1, molten steel was produced in a converter and its composition was appropriately adjusted by addition of Ca. The melt was continuously cast into a slab having a cross-sectional size of 180–300 mm in thickness and 1580 mm in width, and subsequently rolled into heavy plates.

Samples were taken from the cast slab and investigation was conducted as to the number of V segregations, the index of center segregation, and the form of segregations in the finally solidified section. Samples were also taken from the rolled heavy plates and subjected to a hydrogen-induced cracking (HIC) test in order to check the frequency of HIC development. The results are summarized in Table 2. The index of center segregation denotes the thickness of a segregation spot where the Mn concentration in steel was at least 1.3 times the value obtained by analysis in the ladle; the higher this index, the greater the segregation of impurity elements in the steel.

During the continuous casting operation, the casting speed was adjusted to lie within the range of 0.6–1.5 m/min such that the point of time where the solid-phase ratio of the center of the strand was 0.75 fell at the boundary of two roll segments. In addition, the range of stage I-2 was determined by heat conduction analysis such that the borderline between stages I-1 and I-2 corresponded to a central solid-phase ratio of 0.2. Similarly, the ranges of stage I-1 and II were also determined by heat conduction analysis. Each of the roll segments used was composed of six pairs of upper and lower rolls.

Steel samples A and B listed in Table 2 were obtained by achieving appropriate reduction rates in stage I-2; samples C to E were obtained by the same method except that slight reduction in thickness was also effected in stage I-1; and samples F to K were prepared for the purpose of comparison.

As mentioned earlier in this specification, the zero reduction rate (mm/min) means that the gap between upper and lower rolls of each roll pair was set to a constant value in the casting direction so that the thickness of the strand would not be reduced at all during its passage through the roll pairs. In this case, the rolls simply served to support the strand in such a manner that if bulging occurred in the strand, it was controlled.

TABLE 1

| Composition of steel samples under test (wt %) | | | | | | | | | | | |
|---|---|---|---|---|---|---|---|---|---|---|---|
| C | Si | Mn | P | S | Al | Cu | Ni | Ti | V | Ca | N |
| 0.09 | 0.25 | 1.20 | 0.008 | 0.001 | 0.025 | 0.17 | 0.21 | 0.017 | 0.04 | 0.0025 | 0.0034 |

TABLE 2

| | Conditions and results of casting in Example 1 | | | | | | | |
|---|---|---|---|---|---|---|---|---|
| | Sample No. | Rate of reduction in stage I-1 (mm/min) | Rate of reduction in stage I-2 (mm/min) | Rate of reduction in stage II (mm/min) | Number of V or reverse V segregations per m | Index of center segregation | Form of segregation | Frequency of HIC development (%) |
| Samples of the invention | A | 0 | 1.05 | 0 | 0 | 0.3 | Tiny spots | 3 |
| | B | 0 | 0.90 | 0 | 0 | 0.1 | Tiny spots | 1 |

TABLE 2-continued

| | Sample No. | Rate of reduction in stage I-1 (mm/min) | Rate of reduction in stage I-2 (mm/min) | Rate of reduction in stage II (mm/min) | Number of V or reverse V segregations per m | Index of center segregation | Form of segregation | Frequency of HIC development (%) |
|---|---|---|---|---|---|---|---|---|
| | | Conditions and results of casting in Example 1 | | | | | | |
| | C | 0.1 | 0.60 | 0 | 0 | 0.2 | Tiny spots | 2 |
| | D | 0.1 | 0.65 | 0 | 0 | 0.1 | Tiny spots | 1 |
| | E | 0.4 | 0.85 | 0 | 0 | 0.2 | Tiny spots | 2 |
| Comparative samples | F | 0 | 0 | 0 | V (30) | 3.0 | Coarse spots | 70 |
| | G | 0 | 0.3 | 0 | V (30) | 2.5 | Coarse spots | 65 |
| | H | 0 | 0 | 0.8 | V (35) | 5.0 | Linear | 90 |
| | I | 0 | 2.7 | 0 | Reverse V (25) | 2.0 | Coarse spots | 55 |
| | J | 0.5 | 2.5 | 0 | Reverse V (20) | 1.5 | Coarse spots | 45 |
| | K | 1.5 | 2.8 | 0.9 | Reverse V (25) | 3.5 | Coarse spots | 65 |

As Table 2 shows, steel samples A to E prepared in accordance with the present invention were entirely free from any V or reverse V segregation and had low indices of center segregation. The segregation that occurred in these samples was in the form of tiny spots. The frequency of HIC development in these samples was no higher than 5%.

The comparative samples F to K had either V or reverse V segregation; the segregation that occurred in these samples was in a deleterious form, either coarse spots or linear; the samples had high indices of center segregation and the frequency of HIC development was very high.

It was therefore evident that the method of the present invention could yield continuous cast products that were far superior in quality to the comparative samples.

Example 2

With a view to obtaining the composition shown in Table 3, molten steel was produced in a converter, continuously cast into a bloom having a cross-sectional size of 300 mm×500 mm, and subsequently rolled into wire rods. As in Example 1, samples were taken from the cast bloom and investigation was conducted as to the number of V segregations, the index of center segregation, and the form of segregations in the finally solidified section. The results are shown in Table 4.

During the continuous casting operation, the casting speed was adjusted to lie within the range of 0.6–0.9 m/min such that the point of time when the solid-phase ratio of the center of the strand was 0.75 fell at the boundary between two roll segments. In addition, the range of stage I-2 was determined by heat conduction analysis such that the borderline between stages I-1 and I-2 corresponded to a central solid-phase ratio of 0.2. Similarly, the ranges of stages I-1 and II were also determined by heat conduction analysis.

Steel samples A to F listed in Table 4 were obtained by providing the appropriate amounts of reduction in thickness in stage I-2 so as to compensate for the shrinkage due to solidification by the necessary and sufficient degree. It should be noted that in obtaining samples C to F, slight reduction in thickness was also effected in stage I-1. Samples G to L were comparative samples: G was prepared, with an extremely small reduction in thickness being provided in stage I-2; on the hand, H to J were prepared, with an excessive reduction in thickness being provided in stage I-2 (the reduction provided in stage I-1 was also excessive in the case of I and J); K and L were prepared, with no reduction in thickness being provided in stage I-2 (excessive reduction in thickness was achieved in stage II in preparing sample L).

TABLE 3

| C | Si | Mn | P | S | Al | N |
|---|---|---|---|---|---|---|
| Composition of steel samples under test (wt %) | | | | | | |
| 0.72 | 0.23 | 0.74 | 0.013 | 0.004 | 0.032 | 0.0034 |

TABLE 4

| | Sample No. | Rate of reduction in stage I-1 (mm/min) | Rate of reduction in stage I-2 (mm/min) | Rate of reduction in stage II (mm/min) | Number of V or reverse V segregations per m | Index of center segregation | Form of segregation |
|---|---|---|---|---|---|---|---|
| | | Conditions and results of casting in Example 2 | | | | | |
| Samples of the invention | A | 0 | 1.5 | 0 | 0 | 2.0 | Tiny spots |
| | B | 0 | 1.4 | 0 | 0 | 1.7 | Tiny spots |
| | C | 0.2 | 1.6 | 0 | 0 | 2.5 | Tiny spots |
| | D | 0.4 | 2.0 | 0 | 0 | 1.7 | Tiny spots |
| | E | 0.1 | 1.7 | 0 | 0 | 1.6 | Tiny spots |
| | F | 0.3 | 1.5 | 0 | 0 | 1.8 | Tiny spots |
| Comparative samples | G | 0 | 0.3 | 0 | V (40) | 7.5 | Coarse spots |
| | H | 0 | 2.9 | 0 | Reverse V (25) | 6.1 | Coarse spots |
| | I | 0.6 | 2.6 | 0 | Reverse V (20) | 4.5 | Coarse spots |
| | J | 1.5 | 2.8 | 0 | Reverse V (25) | 5.6 | Coarse spots |
| | K | 0 | 0 | 0 | V (43) | 7.7 | Coarse spots |
| | L | 0 | 0 | 0.9 | V (51) | 8.0 | Linear |

As Table 4 shows, steel samples A to F prepared in accordance with the present invention were entirely free from any V or reverse V segregation and had low indices of center segregation. The segregation that occurred in these samples was in the ideal form of tiny spots.

The comparative samples G to L had either V or reverse V segregation; the segregation that occurred in these samples was in a deleterious form, either coarse spots or linear.

It was therefore clear that the method of the present invention could also be used in the continuous casting of blooms which were far superior in quality to the comparative samples.

EXAMPLE 3

With a view to obtaining the composition shown in Table 5, molten steel was produced in a converter and its composition was appropriately adjusted by addition of Ca. The melt was continuously cast into a slab having a cross-sectional size of 240 mm in thickness and 1580 mm in width, and subsequently rolled into heavy plates.

Samples were taken from the cast slab and investigation was conducted as to the index of center segregation and the number of V segregations. Samples were also taken from the rolled heavy plates and subjected to an HIC test in order to check the frequency of HIC development. The results are summarized in Table 6.

TABLE 5

| Composition of steel sample under test (wt %) | | | | | | | | | | | |
|---|---|---|---|---|---|---|---|---|---|---|---|
| C | Ni | Mn | P | S | Al | Cu | Ni | Ti | V | Ca | N |
| 0.10 | 0.25 | 1.31 | 0.007 | 0.001 | 0.024 | 0.15 | 0.21 | 0.016 | 0.04 | 0.0026 | 0.0032 |

TABLE 6

| | Conditions and results of casting in Example | | | | | | |
|---|---|---|---|---|---|---|---|
| | Sample No. | Rate of reduction in stage I-2 (mm/min) | Maximum thermal warpage of rolls (mm) | Maximum wear of rolls (mm) | Number of V or reverse V segregations per m | Index of center segregation | Frequency of HIC development (%) |
| Samples of the invention | A | 0.85 | 0.3 | — | 0 | 0.5 | 5 |
| | B | 0.85 | 0.2 | 0.4 | 0 | 0.1 | 2 |
| Comparative samples | C | 0.85 | 1.2 | 0.3 | 0 | 2.4 | 38 |
| | D | 0 | 0.3 | — | V (30) | 3.0 | 55 |
| | E | 2.8 | 0.2 | — | Reverse V (22) | 4.8 | 65 |

During the continuous casting operation, the casting speed was adjusted to 1.0 m/min so that the point of time when the solid-phase ratio of the center of the strand was about 0.7 fell at the boundary of two roll segments. The region which covered upstream from said boundary of roll segments was used as stage I-2. In preparing steel samples A and B of the present invention and comparative sample C, the roll gap was preliminarily adjusted so that the reduction rate in stage I-2 would be 0.85 mm/min. The length of stage I-2 was determined by heat conduction analysis such that the borderline between stages I-1 and I-2 would correspond to a central solid-phase ratio between 0.1 and 0.3. Steel samples A and B of the present invention and comparative samples D and E were cast with pairs of divided rolls each consisting of three separate members so as to minimize the thermal warpage of rolls. The measurement of roll displacements during the casting operation showed that each of the rolls experienced thermal warpage of less than 0.5 mm. However, one-piece rolls were used in casting comparative sample C and the greatest thermal warpage of rolls that occurred was 1.2 mm. Comparative sample D had V segregations that developed as a result of fluidization of the molten steel which accompanied shrinkage due to solidification; comparative sample E had reverse V segregations owing to excessive reduction in thickness. Both comparative samples D and E showed high frequency of HIC development. Comparative sample C was given the appropriate amount of reduction in thickness so that no fluidization of the molten steel occurred owing to shrinkage upon solidification. However, the rolls experienced thermal warpage and the molten steel was fluidized as a result of uneven reduction in thickness. Therefore, comparative sample C could not achieve satisfactory improvement in terms of the center segregation. In contrast, sample A of the present invention achieved significant improvement over comparative sample C as a result of the combined effect of appropriate reduction in thickness and prevention of thermal warpage of rolls. Sample B of the present invention was prepared by the same method as sample A except that the number of the uses of the rolls was especially controlled such that the roll wear would not exceed 0.4 mm. Because of this special care, sample B achieved an even greater improvement over sample A in terms of segregation. It was therefore evident that the effect of maintaining the thermal warpage of rolls to be less than 0.5 mm in decreasing the center segregation could be further enhanced by ensuring that the roll wear would be less than 0.5 mm.

EXAMPLE 4

With a view to obtaining the composition shown in Table 7, molten steel was produced in a converter and its composition was appropriately adjusted by addition of Ca. The melt was continuously cast into a slab having a cross-sectional size of 240 mm in thickness and 1580 mm in width, and subsequently rolled into heavy plates.

Samples were taken from the cast slab and investigation was conducted as to the index of center segregation and the number of V segregations. Samples were also taken from the rolled heavy plates and subjected to an HIC test in order to check the frequency of HIC development. The results are summarized in Table 8.

TABLE 7

| Composition of steel samples under test (wt %) | | | | | | | | | | | |
|---|---|---|---|---|---|---|---|---|---|---|---|
| C | Si | Mn | P | S | Al | Cu | Ni | Ti | V | Ca | N |
| 0.10 | 0.24 | 1.29 | 0.006 | 0.001 | 0.026 | 0.16 | 0.20 | 0.018 | 0.04 | 0.0026 | 0.0032 |

TABLE 8

| | Sample No. | Rate of reduction in stage I-2 (mm/min) | Maximum surface temperature of strand in stage I-2 (°C.) | Maximum thermal warpage of rolls (mm) | Number of V or reverse V segregations per m | Index of center segregation | Frequency of HIC development (%) |
|---|---|---|---|---|---|---|---|
| | | Conditions and results of casting in Example 4 | | | | | |
| Samples of the invention | A | 0.85 | 780 | 0.2 | 0 | 0.1 | 1 |
| | B | 0.85 | 870 | 0.2 | 0 | 0.5 | 3 |
| | C | 0.85 | 780 | 0.8 | 0 | 1.0 | 7 |
| Comparative samples | D | 0.85 | 960 | 1.2 | 0 | 2.3 | 39 |
| | E | 0 | 780 | 0.3 | V (30) | 3.2 | 54 |
| | F | 2.8 | 780 | 0.2 | Reverse V (22) | 4.5 | 67 |

During the continuous casting operation, the casting speed was adjusted to 1.0 m/min so that the point of time when the solid-phase ratio of the center of the strand was about 0.7 fell at the boundary of two roll segments. The region which covered upstream from said boundary of roll segments was used as stage I-2. In preparing steel samples A, B and C of the present invention and comparative sample D, the roll gap was preliminarily adjusted so that the reduction rate in stage I-2 would be 0.85 mm/min. The length of stage I-2 was determined by heat conduction analysis such that the borderline between stage I-1 and I-2 would correspond to a central solid-phase ratio between 0.1 and 0.3. Steel samples A, B and C of the present invention and comparative samples E and F were cast in such a manner that the surface temperature of the strand was maintained to be not higher than 900° C. in stage I-2 by subjecting the strand to strong cooling in the secondary cooling section in order to minimize extremely the distortion of the solidified shell caused by subjecting to uneven reduction in thickness. Comparative sample D was cast in a manner that the surface temperature of the strand was 960° C. in stage I-2 because it was cooled moderately for the purpose of comparing. Steel samples A and B of the present invention and comparative samples E and F were cast with pairs of divided rolls each consisting of three separate members so as to minimize the thermal warpage of rolls. The measurement of roll displacements during the casting operation showed that each of the rolls experienced thermal warpage of less than 0.5 mm. However, one-piece rolls were used in casting sample C of the present invention and comparative sample D and the greatest amount of thermal warpage of rolls that occurred in the respective samples were 0.8 mm and 1.2 mm. Comparative sample E had V segregations as a result of insufficient reduction in the thickness of the strand; comparative sample F had reverse V segregations as a result of excessive reduction in thickness; and comparative sample D was given the appropriate amount of reduction in thickness but because of the great thermal warpage of rolls and the high surface temperature of the strand, sample D could achieve only insufficient improvement in terms of segregation. In addition, each of the three comparative samples showed high frequency of HIC development. This was in sharp contrast with samples A, B and C of the present invention which were given the appropriate amounts of reduction in thickness, the surface temperatures of which were maintained to be not higher than 900° C. by controlling water amount of spraying and which showed less than 10% frequency of HIC development. The superiority of the method of the present invention was therefore evident. Of the three samples of the present invention, sample C showed the highest frequency of HIC development, but even this sample was by far superior to sample D in terms of segregation. This was because of the combination of the following two effects: the low surface temperature of the strand led to the formation of a solidified shell having enhanced rigidity; and the spraying of increased water caused a drop in the surface temperature of the rolls, which hence led to a decreased thermal warpage of the rolls.

What is claimed is:

1. A method of the continuous casting of molten metal by continuously withdrawing a strand, characterized in that the thickness of the strand is continuously reduced at a rate of 0.5 mm/min to less than 2.5 mm/min in the region between the point of time when the center of the strand has a temperature corresponding to a solid-phase ratio of 0.1 to 0.3 and the point of time when said temperature has dropped to a level corresponding to the solid-phase ratio at the limit of fluidization, while substantially no reduction in thickness is effected in the region between the point of time when the center of the strand has a temperature corresponding to the solid-phase ratio at the limit of fluidization and the point of time when said temperature has dropped to the solidus line.

2. A continuous casting method as defined in claim 1 wherein said solid-phase ratio at the limit of fluidization is within the range of 0.6 to 0.9.

3. A continuous casting method as defined in claim 1 wherein the amount of thermal warpage of rolls that occurs during casting in the region between the point of time when the center of the strand has a temperature corresponding to a solid-phase ratio of 0.1 to 0.3 and the point of time when said temperature has dropped to a level corresponding to the solid-phase ratio at the limit of fluidization is maintained to be less than 0.5 mm.

4. A continuous casting method as defined in claim 1 wherein the amount of wear of rolls is maintained to be less than 0.5 mm in the region between the point of time when the center of the strand has a temperature corresponding to a solid-phase ratio of 0.1 to 0.3 and the point of time when said temperature has dropped to a level corresponding to the solid-phase ratio at the limit of fluidization.

5. A continuous casting method as defined claim 1 wherein the surface temperature of the strand is maintained to be not higher than 900° C. in the region between the point of time when the center of the strand has a temperature corresponding to a solid-phase ratio of 0.1 to 0.3 and the point of time when said temperature has dropped to a level corresponding to the solid-phase ratio at the limit of fluidization.

6. A continuous casting method as defined in claim 1 wherein said molten metal is molten steel.

* * * * *